United States Patent [19]

Watanabe et al.

[11] Patent Number: 4,840,881

[45] Date of Patent: Jun. 20, 1989

[54] PROCESS FOR THE PRODUCTION OF LIGHT-SENSITIVE SILVER HALIDE PHOTOGRAPHIC MATERIAL

[75] Inventors: Yoshikazu Watanabe, Hino; Motoaki Tanaka, Hachioji, both of Japan

[73] Assignee: Konishiroku Photo Industry Co., Ltd., Tokyo, Japan

[21] Appl. No.: 223,713

[22] Filed: Jul. 21, 1988

Related U.S. Application Data

[63] Continuation of Ser. No. 894,475, Aug. 4, 1986, abandoned, which is a continuation of Ser. No. 682,481, Dec. 17, 1984, abandoned, which is a continuation of Ser. No. 548,421, Nov. 3, 1983, abandoned, which is a continuation of Ser. No. 471,602, Mar. 4, 1983, abandoned, which is a continuation of Ser. No. 297,119, Aug. 28, 1981, abandoned, which is a continuation of Ser. No. 875,875, Feb. 7, 1978, abandoned.

[30] Foreign Application Priority Data

Feb. 10, 1977 [JP] Japan ..... 13601

[51] Int. Cl.[4] ..... G03C 7/32

[52] U.S. Cl. ..... 430/512; 430/510; 430/523; 430/527; 430/539; 430/546; 430/935; 430/961

[58] Field of Search ..... 430/510, 523, 527, 539, 430/935, 961, 512, 546

[56] References Cited

U.S. PATENT DOCUMENTS

| | | | |
|---|---|---|---|
| 3,554,755 | 1/1971 | Rinauro | 430/543 |
| 3,619,199 | 11/1971 | Mackey | 430/635 |
| 3,625,692 | 12/1971 | Meyer et al. | 430/523 |
| 3,666,478 | 5/1972 | Groh et al. | 430/635 |
| 3,775,126 | 11/1973 | Babbit et al. | 430/636 |
| 4,050,940 | 9/1977 | Habu et al. | 430/935 |

OTHER PUBLICATIONS

Lyman, R. A. American Pharmacy, 1945, pp. 135–137; 150–152; 154–163; J. B. Lippincott, Philadelphia.

*Primary Examiner*—Richard L. Schilling
*Assistant Examiner*—Janet C. Baxter
*Attorney, Agent, or Firm*—Jordan B. Bierman

[57] ABSTRACT

A process for the preparation of a light-sensitive silver halide photographic material comprising a support, a silver halide emulsion layer, and a non-light-sensitive hydrophilic colloid layer which consists essentially of a plurality of layer elements; a process comprises incorporating oil particles into at least one of the elements, so that the oil particle density of the outermost layer element is not the highest of the oil particle densities of all of the elements.

27 Claims, No Drawings

PROCESS FOR THE PRODUCTION OF LIGHT-SENSITIVE SILVER HALIDE PHOTOGRAPHIC MATERIAL

This application is a continuation of application Ser. No. 894,475 filed 8/4/86, now abandoned, which is a continuation of application Ser. No. 682,481 filed 12/17/84, now abandoned, which is a continuation of application Ser. No. 548,421 filed Nov. 3, 1983, now abandoned, which is a continuation of application Ser. No. 471,602, filed Mar. 4, 1983, now abandoned, which is a continuation of application Ser. No. 297,119 filed Aug. 28, 1981, now abandoned, which is a continuation of application Ser. No. 875,875, filed Feb. 7, 1978, now abandoned, which claims the priority of Japanese application No. 13601/77, filed Feb. 10, 1977.

This invention relates to a process for the preparation of a light-sensitive silver halide photographic material, and in particular to a process for the preparation of a light-sensitive silver halide photographic material having improved surface properties.

Usually, a light-sensitive silver halide photographic material (referred to hereinafter merely as a "light-sensitive material") is prepared by applying on the silver halide emulsion layer a surface layer having, as the binder, a hydrophilic colloid such as gelatine. However, the light-sensitive material prepared in such manner often causes adhesion during the preparation, photographing, processings, projection or preservation due to contact between the light-sensitive materials or contact with another substance.

As a way of solving this problem, there has been employed by those skilled in the art a process for increasing the roughness of the surface of the light-sensitive material by applying thereto a coating solution having a hydrophilic colloid in which fine particles of an inorganic substance such as silicon dioxide, titanium dioxide, magnesium oxide and calcium carbonate or an organic substance such as polymethyl methacrylate, cellulose acetate propionate are included therein, and/or so-called a process for reducing adhesion by matting the surface. However, in the preparation of the light-sensitive material according to the above process, the following undesirable problems have resulted: The formation of an aggregate in the photographic coating solution which contains the matting agent makes even coating impossible; because of degradation in the sliding properties of the surface of the resulting light-sensitive material, the light-sensitive material or photographic material becomes damaged or the driving properties of the light-sensitive material or photographic material in a photographic apparatus or projecting apparatus is degraded; transparency of the processed photographic material is lowered; or the granularity of an image is damaged.

On the other hand, it has been suggested that the addition of an oily compound, insoluble in water (such as a high-boiling organic solvent), in the form of an oil particle prepared by the emulsification and dispersion of the binder, will improve the adhesion properties of the film of the light-sensitive material. The purpose of this oily compound is to also reduce brittleness and to prevent the so-called reticulation encountered in photographic processing.

Further, it has also been suggested to add various photographic additives into the oil particles depending upon the object. For example, inclusion of a UV absorbing agent into the oil particles with a view to attaining an antistatic effect and an improved preservability; inclusion of a color fading inhibitor or antioxidant into the oil particles with a view to attaining improved preservation; or inclusion of the so-called DIR compound which releases, by reaction with an oil-soluble coupler and the oxidation product of a developing agent, a development inhibiting compound while at the same time forms a substantially colorless compound. A color-mixing inhibiting agent or antistain agent has also been routinely used.

However, although the formation of an aggregate in the photographic coating solution or the sliding properties resulting from coating of a surface layer on the light-sensitive material were improved, the adhesion properties were degraded under high temperature, particularly under high temperature and high humidity. When the oil particle density of the binder in the surface layer of the manufactured light-sensitive material is high, particularly under high temperature and high humidity, so-called sweating occurs where the oil particles dispersed in the binder are assembled and ooze as sweat on the surface. In other words, the surface becomes sticky or, in particular cases, the surface of the light-sensitive material or the processed photographic material is devitrified.

The above-phenomena happens during the preparation of the light-sensitive material, not only when the layer containing oil particles is applied as the outermost layer of the final product, but also when said oil particle-containing layer is positioned as an intermediate at the layer surface. This is disadvantageous because the light-sensitive materials adhered to each other, especially when the light-sensitive material is rolled up or when the light-sensitive material is preserved.

In order to avoid the above-mentioned disadvantages, it was determined that an increase in particle density of the surface layer or a reduction in the thickness of the surface layer was unsatisfactory. Further, when a surface active agent is added to the oil particle-containing layer (for example, as antistatic agent, as emulsifying and dispersing agent or as coating aid), the surface active agent is consumed by the oil particles and, therefore, a large quantity of the surface active agent was required to achieve its intended purpose. This resulted in foaming of the coating solution. Additionally, when the resulting light-sensitive material is further processed, the surface active agent flows into the processing solution and foaming of the processing solution results.

The first object of this invention is to provide a process for the preparation of a non-adhesive light-sensitive material. The second object of this invention is to provide a process for the preparation of a light-sensitive material which does not result in any so-called sweating. The third object of this invention is to provide a process for the preparation of a light-sensitive material, which provides for a reduction in the amount of the surface active agent or an antistatic agent used. The fourth object of this invention is to provide a light-sensitive agent showing less variation with time in the surface properties.

As a result of extensive research, it has been found that various objects of this invention can be achieved by the preparation of a light-sensitive material having at least one silver halide emulsion layer and at least one non-light-sensitive hydrophilic colloid layer on a support which comprises incorporating oil particles into at least one of a plurality of layer elements of said hydrophilic colloid layer wherein the density of the oil particles of the outermost layer element is less than the oil particle density of at least one of said elements.

The term "oil particle" as used herein means a finely divided liquid particle which is substantially insoluble in water, permitting it to exist in a hydrophilic binder independently in the oily state. The average particle size diameter of such oil particle is generally 0.01–10μ and typically in the range of 0.1–10μ. As a material which forms oil particles, there is included an organic high-boiling-point compound which is usually used for the dispersion of photographic couplers. It may be such as described, for example, in U.S. Pat. Nos. 2,322,027; 2,801,170; 2,801,171; 2,272,191 and 2,304,940, sodium higher alkylsulfate as described in U.S. Pat. Nos. 2,882,157; 3,121,060 and 3,850,640 and Japanese Patent L-O-P Publication No. 51-141623, and an ester of a higher fatty acid with a higher alcohol (so-called wax), polyethyleneglycol having a high molecular weight, higher alkyl phosphate or so-called lubricant of silicon compounds.

Further, such compounds which are solid at normal temperature but liquid when included in the hydrophilic colloid layer, can contain various photographic additives. As examples of such compounds, those having a melting point not more than 50° C. are generally used.

A latex dispersion solution comprising dispersed polymer particles which themselves have no fluidity may not be included in the oil particles as defined in this invention since the advantages thereof are not satisfactory.

As the organic high-boiling compounds, those having a boiling point of 180° C. or higher at a normal pressure are typical and examples thereof include diethyl adipate, dibutyl adipate, di-iso-butyl adipate, di-n-hexyl adipate, di-octyl adipate, di-cyclohexyl azelate, di-2-ethylhexyl azelate, di-octyl sebacate, di-iso-octyl sebacate, dibutyl succinate, octyl stearate, dibenzylphthalate, tri-o-cresyl phosphate, diphenylmono-p-tert-butylphenyl phosphate, monophenyl-di-o-chlorophenyl phosphate, monobutyl-di-octyl phosphate, 2,4-di-n-amyl-phenol, 2,4-di-tert.-amyl-phenol, 4-n-nonylphenol, 2-methyl-4-n-octyl phenol, N,N-diethylcaprylamide, N,N-diethyl-laurylamide, glycerol triallopionate, glycerol tributyrate, glycerol monolactate diacetate, tributyl citrate, acetyltriethyl citrate, di-2-ethylhexyl adipate, dioctyl sebacate, di-iso-octyl azelate, diethylene glycol dibenzoate, dipropylene glycol dibenzoate, triethyl citrate, tri-(2-ethylhexyl) citrate, acetyl tri-n-butylcitrate, di(isodecyl)4,5-epoxytetrahydro phthalate, oligo vinyl ethyl ether, dibutyl fumarate, polyethylene oxide (polymerization grade (n)>16), glycerol tributyrate, ethylene glycol difluoro piorrate, di-(2-ethylhexyl)isophthalate, butyl laurate, tri-(2-ethylhexyl)phosphate, triphenyl phosphate, tri-cresyl phosphate, silicone oil, dimethyl phthalate, diethyl phthalate, dipropyl phthalate, dibutyl phthalate, di-iso-octyl phthalate, diamyl phthalate, di-n-octyl phthalate, diamyl naphthalene, tri-amyl naphthalene, monocaprin, monolaurin, monomyristin, monopalmitin, monostearin, monoolein, dicaprin, dilaurin, dimyristin, dipalmitin, distearin, diolein, 1-stearo-2-palmitin, 1-palmito-3-stearin, 1-palmito-2-stearin, triacetin, tricaprin, trilaurin, trimyristin, tripalmitin, tristearin, triolein, tripetroselin, trierucin, triricinolein, linoleodistearin, linoleodilinolenin, oleodierucin, linoleodierucin, palmitooleolinolenin, paraffin, drying oil such as linseed oil, soybean oil, perilla oil, tung oil, hempseed oil, kaya oil, walnut oil, soysauce oil, poppy seed oil, sunflower oil, catalpa oil, arrowhead oil or safflower oil; semi-drying oil such as cotton seed oil, corn oil, sesame oil, rapeseed oil, rice bran oil, lotus oil, mustard oil, kapok oil or dehydrated castor oil; peanut oil, olive oil, tsubaki oil, sasanqua oil, tea seed oil, castor oil, hydrogenated castor oil, almond oil, chaulmoogra oil.

Further, a compound of the formula

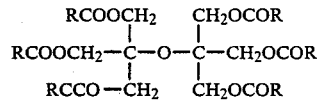

or

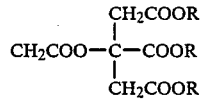

in which R represents an alkyl group having 1 to 8 carbon atoms, can also be used in this invention as the organic high boiling-point compound.

Among the above, esters of glutaric acid, adipic acid, phthalic acid, sebacic acid, succinic acid, maleic acid, fumaric acid, magelaic acid, isophthalic acid, terephthalic acid and phosphoric acid; or ester of glycerin; paraffin; and fluorinated paraffin can preferably be used, in view of the favorable properties thereof that said compounds have no adverse effect on the light-sensitive material, are readily available and chemically stable and can be handled very easily. Further, tricresyl phosphate, triphenyl phosphate, dibutyl phthalate, di-n-octyl phthalate, di-2-ethylhexyl phthalate, glycerol tributyrate, glycerol tripropionate, dioctyl sebacate, paraffin, fluorinated paraffin and silicone oil are particularly preferred in the present invention as the high-boiling-point compounds.

In the present invention, formation of the oil particles may be effected according to any known method. A typical method comprises, for example, dissolving one or more compounds which form oil particles, such as the above-mentioned high-boiling-point compounds, if necessary, together with photographic additives as referred to hereinlater and further, if necessary, dissolving said compounds in a low-boiling-point solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane tetrahydrofuran, methyl alcohol, ethyl alcohol, propyl alcohol, fluorinated alcohol, acetonitrile, dimethylformamide, dioxane, acetone, methyl ethyl ketone, methyl isobutyl ketone, etc. (these low-boiling-point solvents may be used alone or in combination), mixing with an aqueous solution which contains a hydrophilic binder such as gelatine containing an anionic surface active agent, e.g. alkylbenzenesulfonic acid and alkylnaphthalene-sulfonic acid and/or nonionic surface active agent, e.g. sorbitan sesquioleic acid ester and sorbitan monolauric acid ester, emulsifying and dispersing the mixture by means of a high speed rotary mixer, a colloid mill or a supersonic dispersion apparatus, adding the dispersion solution thus obtained to a coating solution containing a hydrophilic colloid binder and then applying the coating solution on a support, if necessary, through a silver halide emulsion. Further, some of the compounds which form oil particles may be dissolved in a low-boiling-point organic solvent, for example, as mentioned above and the resulting solution may be added directly to a solution of the photographic additives.

The low-boiling-point organic solvent used at this stage will be evaporated during a course of coating and drying and thereafter scarcely be present in the binder.

In the present invention, varous photographic additives may be added into the oil particles. As such photographic additives to be included, any additives such as hydrophilic additives, oleophilic additives, etc. may be used and preferably oleophilic additives are used. Examples of said oleophilic additives include an oil-soluble coupler, a UV-absorber, a development inhibitor releasing compound (so-called DIR compound), antistain agent such as a hydroquinone derivative, a color fading inhibiting agent and an antioxident as the typical ones.

As oil-soluble couplers which may be included in the oil particle, yellow couplers, magenta couplers and cyan couplers which form dye images by a color development may be used.

As the typical couplers which can be used in this invention, those compounds as described in the following patent specifications are included:

As the yellow coupler can be cited benzoylacetanilide type, pivaloylacetanilide type and 2 equivalent type couplers wherein the carbon atom at the coupling position is substituted with a substituent which can be split-off on a coupling reaction (that is so-called a split off group). These couplers are described, for example, in U.S. Pat. Nos. 2,875,057; 3,265,506; 3,664,841; 3,402,194; 3,447,928; 3,277,155 and 3,415,652, Japanese Patent Publication No. 49-13576, Japanese Patent L-O-P Publications No. 48-29432; No. 48-66834; No. 49-10736; No. 49-122335; No. 50-28834 and No. 50-132926.

As the magenta coupler, there are included 5-pyrazolone type, pyrazolotriazole type, pyrazolino-benzimidazole type, indazolone type and split off group-containing 2 equivalent type magenta couplers, which are described, for example, in U.S. Pat. Nos. 2,600,788; 3,062,653; 3,127,269; 3,311,476; 3,419,391 3,519,429; 3,558,318; 3,684,514 and 3,888,680, Japanese Patent L-O-P Publications No. 49-29639; No. 49-111631; No. 49-129538 and No. 50-13041, Japanese Patent Applications No. 50-24690; No. 50-134470 and 50-156327, British Pat. No. 1,247,493, Belgian Pat. No. 792,523, U.S. Pat. No. 3,061,432, German Pat. No. 2,156,111, Japanese Patent Publication No. 46-60479 and Belgian Pat. No. 769,116.

As the cyan coupler, there are included phenol type, naphthol type and split off group-containing 2-equivalent type cyan couplers, which are described, for example, in U.S. Pat. Nos. 2,423,730; 2,474,293; 2,801,171; 2,895,826; 3,476,563; 3,737,326; 3,758,308 and 3,893,044, Japanese Patent L-O-P Publications No. 47-37425; No. 50-10135; No. 50-25228; No. 50-112038; No. 50-117422 and No. 130441.

Furthermore, couplers which can be included in the oil particles according to this invention, may be so-called colorless coupler which is oil-soluble and forms no colored dye by the reaction with an oxidation product of a developing agent.

As the UV-absorber which can be included in the oil particles according to the present invention, there can be used, for example, benzotriazoles as described in U.S. Pat. Nos. 3,253,921; 3,004,896; 3,267,113 and 3,692,525; British Pat. Nos. 980,886; 1,239,258 and 1,256,025, Belgian Pat. Nos. 623,419; 625,007; 670,016, German Pat. No. 2,151,098, Japanese Patent Publications No. 41-16857 and No. 41-191779; thiazolidones as described in U.S. Pat. Nos. 2,882,150; 2,739,971; 2,798,067; 2,875,053; 3,352,681; 2,739,888; 2,719,162; 2,808,330 and 3,365,295; acrylonitriles as described in Japanese Patent L-O-P Publication No. 47-10537, Japanese Patent Publications No. 48-30492; No. 49-43888; No. 48-31255 and No. 48-35376 and Belgian Pat. No. 833,511; benzophenones as described in British Pat. No. 1,321,355 and U.S. Pat. No. 3,215,530 and further such UV-absorbers as described in U.S. Pat. Nos. 3,271,156; 2,748,021; 2,685,512; 2,763,566 and 2,632,701 and German Pat. No. 1,023,859. Furthermore, as the DIR compound, those described in U.S. Pat. Nos. 3,297,445; 3,364,022; 3,379,529; 3,639,417 and 3,958,993, Japanese Patent Publication No. 51-16142, Japanese Patent L-O-P Publications No. 49-104630; No. 51-6724; No. 50-119631; No. 50-2537; No. 51-64927 and No. 51-72433 can also be included in the oil particles.

In the oil particles of the present invention, an antistain agent represented by a hydroquinone derivative may be included. Such hydroquinone derivatives are those having the hydroquinone nucleus and substituted, at one hydrogen atom on the hydroquinone nucleus, with one substituent selected from the group consisting of an alkyl group (e.g. methyl, tert.-butyl, octyl, tert.-octyl, dodecyl, octadecyl, etc.); an aryl group (e.g. phenyl, etc.); an alkoxy group (e.g. methoxy, butoxy, dodecyloxy, etc.); an aryloxy group (e.g. phenoxy, etc.); a carbamoyl group (e.g. methylcarbamoyl, dibutylcarbamoyl, octadecylcarbamoyl, phenylcarbamoyl, etc.); a sulfamoyl group (e.g. methylsulfamoyl, octadecylsulfamoyl, etc.); an acyl group (e.g. acetyl, butyroyl, octanoyl, lauroyl, etc.); an alkoxycarbonyl (e.g. methoxycarbonyl, dodecyloxycarbonyl, etc.) and an aryloxycarbonyl (e.g. phenoxycarbonyl, etc). Further, the an alkyl group or an aryl group in the above-mentioned can include the substituted with a substituent such as halogen, an alkyl group, an aryl group, an alkoxy group, an aryloxy group, a carboxy group, an alkoxycarbonyl group, an acyl group, an acyloxy group, a carbamoyl group, a sulfo group, a sulfamoyl group, a sulfonamido group, an N-alkyl-amino group, an N-arylamino group, an acylamino group, an imido group and a hydroxy group. Further, 1 to 3 hydrogen of the remaining 3 hydrogen on the hydroquinone nucleus may be substituted with 1 to 3 substituents selected from the group consisting of a halogen and those substituents as mentioned above, and in such case, 2 to 4 substituents in total may be the same or different to one another. The hydroquinone derivatives according to this invention further include such compound that releases, through hydrolysis, a hydroquinone derivative which satisfies the above-mentioned definitions. As such compound, for example, a hydroquinone compound in which 1 or 2 hydroxy groups on the hydroquinone nucleus are acylated can be included and the acyl group includes, for example, an aliphatic carbonyloxy group, an aliphatic oxycarbonyloxy group, an aliphatic oxyoxalyloxy group (in which, as the aliphatic group, an alkyl group is preferable).

Among the above-mentioned hydroquinone derivatives, those in which the total carbon atom number contained in the substituents on the hydroquinone nucleus is 8 or more are preferable in the present invention, and total carbon atom contained in the substituents on the hydroquinone nucleus is most preferably 8–32. Those in which the substituents on the nucleus are substituted or unsubstituted alkyl groups are particularly preferable.

Examples of the hydroquinone derivatives used in this invention are described, for example, in U.S. Pat. Nos. 2,336,327; 2,360,290; 2,384,658; 2,403,721; 2,418,613; 2,675,314; 2,701,197; 2,704,713; 2,710,801; 2,722,556; 2,728,659; 2,732,300; 2,735,765; 2,816,028; 3,062,884 and 3,236,893, British Pat. Nos. 557,750 and 557,802, DOS 2,149,789, Japanese Patent Publication No. 44-54116, Japanese Patent L-O-P Publication No. 46-2128 and Journal of Organic Chemistry, 22, 772–774.

Hydroquinone derivatives used in this invention will be exemplified below, without any intention of limiting thereto.

Hq-1 2,5-di-tert.-octylhydroquinone
Hq-2 2-tert.-octyl-5-methylhydroquinone
Hq-3 2,6-di-n-dodecyl-hydroquinone
Hq-4 2-n-dodecylhydroquinone
Hq-5 2,2-methylenebis-5,5-di-tert.-butylhydroquinone
Hq-6 2,5-di-n-octyl-hydroquinone
Hq-7 2-dodecylcarbamoylmethylhydroquinone
Hq-8 2-(β-n-dodecyloxycarbonyl)ethyl-hydroquinone
Hq-9 2-(N,N-dibutylcarbamoyl)hydroquinone
Hq-10 2-n-dodecyl-5-chloro-hydroquinone
Hq-11 2-(2-octadecyl)-5-methylhydroquinone
Hq-12 2,5-di-(p-methoxyphenyl)hydroquinone
Hq-13 2-tert.-octylhydroquinone
Hq-14 2-(β-{3-(3-sulfobenzamido)benzamido}ethyl-hydroquinone
Hq-15 2,5-dichloro-3,6-diphenylhydroquinone
Hq-16 2,6-dimethyl-3-tert.-octylhydroquinone
Hq-17 2,3-dimethyl-5-tert.-octylhydroquinone
Hq-18 2-{β-(dodecanoyloxy)ethyl}carbamoylhydroquinone
Hq-19 2-dodecyloxycarbonylhydroquinone
Hq-20 2-{β-(4-octaneamidophenyl)ethyl}hydroquinone
Hq-21 2-methyl-5-dodecylhydroquinone The hydroquinones used in this invention can be synthesized according to the processes as described in the above-mentioned patent specifications.

As the antistain agent, those compounds as described in Japanese Patent Publications No. 45-14034; No. 49-8338; No.49-6208 and No. 49-20977, U.S. Pat. Nos. 3,432,300; 3,698,909; 2,360,290 and 2,336,327, German Pat. No. 2,008,376, are effective.

According to this invention, oil particles which may be those consisting of a high boiling-point organic compound alone and those comprising the above-mentioned oleophilic photographic additives in addition thereto may be prepared separately and then added to the non-light-sensitive hydrophilic colloid coating solution to give a light-sensitive material. Further, oil particles may be either those which are formed at the same time by using two or more kinds of high boiling organic-point compounds or those which are prepared by mixing compounds which have been separately emulsified and dispersed.

The surface active agents used for the dispersion according to the present invention are explained in detail in Japanese Patent Publication No. 48-9979, Japanese Patent L-O-P Publication No. 50-134428; No. 51-3219 and No. 51-32322, U.S. Pat. Nos. 2,240,472; 2,271,623; 2,288,226; 2,311,021; 2,322,027; 2,360,289; 2,533,514; 2,739,891; 2,801,170; 2,801,171; 2,852,382; 2,949,360; 3,068,101; 3,158,484; 3,201,253; 3,210,191; 3,294,540; 3,396,027; 3,415,649; 3,441,413; 3,442,654; 3,475,174; 3,545,974; 3,619,195 and 3,775,349, German Pat. No. (OLS) 1,942,665, German Pat. Nos. 1,143,707; 2,045,414; 2,043,271 and 2,045,464, and Britsh Pat. Nos. 1,077,317 and 1,198,450. Among these surface active agents, one or more can be selected. An amount of the surface active agent may be varied optionally and may be at least such that is substantially necessary for obtaining an emulsion.

The term "oil particle density" as used herein is defined by the ratio of the total volume of oil particles added into a layer element of the non-light-sensitive hydrophilic colloid layer to the total volume of a binder contained in said element and referred to hereinafter as "oil/binder".

In the non-light-sensitive hydrophilic colloid coating solution for the outermost layer element according to the present invention, various hydrophylic colloids are used as the binder.

As the binder, gelatine and modified gelatines such as phthalated or malonated gelatin are generally used. Further, in place of a part or whole of such gelatine and derivatives thereof, there can be used albumin, agar, gum arabic, alginic acid, casein, partially hydrolysed cellulose derivatives, polyvinyl alcohol, partially hydrolysed polyvinyl acetate, polyacrylic acid, polyacrylamide and its imidation product, polyvinyl pyrrolidone and copolymers of these vinyl compounds.

The outermost layer element of the non-light-sensitive hydrophilic colloid layer according to this invention is existing in the surface thereof in layer form. In the present invention, the most preferred embodiment is such that the outermost layer element is on the outermost surface of a finished light-sensitive material. A light-sensitive material is ordinarily prepared by such process as comprising coating one or more layers successively and therefore even when it is an inter layer in the final product, the non-light-sensitive hydrophilic colloid layer may also have been the outermost layer during a certain preparation step of the light-sensitive material.

The outermost layer in this invention may be applied on both sides of the support. For example, when silver halide emulsion layers are applied on both sides of the support, the outermost layers may be applied on both of the above sides or may be applied on the opposite side of the silver halide emulsion layer applied on the support, that is the back surface of the light-sensitive material. The thickness of the outermost layer element applied according to this invention is generally 0.2–5μ and preferably 0.5–3μ.

The preferred oil particle density of the outermost layer element varies depending upon the type and size of the oil particles and the type and properties of a binder in the non-light-sensitive hydrophilic colloid layer applied as well as the state of dryness of the light-sensitive material including said non-light-sensitive hydrophilic colloid layer. Generally, however, not more than 0.3 oil/binder, particularly not more than 0.15 oil/binder is preferable.

Further, in te process for the preparation according to this invention, the combination use of an organic fluorine-containing surface active agent on the application of the non-light-sensitive hydrophilic colloid layer has been found to be effective not only in the particular improvement in adhesion properties but also in the increase of use efficiency of such organic fluorine-containing surface active agent and diminution of variation with time of the surface properties due to the use of the above compound. This is the effect which could not be attained by the use of other surface active agents. The organic fluorine-containing surface active agents are in general used with a view to, in addition to improving the adhesion properties and sliding properties, preventing electrification or regulating the electrification line at the surface.

The organic fluorine-containing surface active agents that can be used together in this invention include linear or cyclic compounds containing at least 3 fluorine atoms and at least 3 carbon atoms and any type of cation-, nonion-, anion- or betaine-type compound can preferably be used.

Typical examples of the organic fluorine-containing surface active agents which can be used in this invention are described, for example, in U.S. Pat. Nos. 3,589,906; 3,666,478; 3,754,924; 3,775,126 and 3,850,640, British Pat. No. 1,330,356.

Among the organic fluorine-containing surface active agents used in this invention, typical examples thereof will be given below.

$CF_3-(CF_2)_6-COONH_4$ (1)

$CF_3-(CF_2)_9-(CH_2)_{10}-COOH$ (2)

$CF_3(CF_2)_5-(CH_2)_{10}-COONa$ (3)

$Cl-CF_2-(CF(Cl)-CF_2)_4-COOH$ (4)

$H-(CF_2)_{10}-COONa$ (5)

$HOOC-(CF_2-CF(Cl)-CF_4)_4-COOH$ (6)

$Cl(CF_2-CF(Cl))_3-CF_2-COOK$ (7)

$CF_2-(CF_2)_6-CH=CH-(CH_2)_3COONa$ (8)

$CF_3-(CF_2)_3-CF(CF_3)-(CH_2)_{10}-COONa$ (9)

(10)

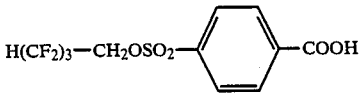

$CF_3(CF_2)_7-CO-N(CH_3)-(CH_2)_2-COONa$ (11)

$Cl(CF_2)_6-COONa$ (12)

$CF_3-(CF_2)_3-CH_2CH_2-SO_2-N(C_2H_5)-CH_2-COONa$ (13)

$CF_3(CF_2)_7-SO_2-N(C_2H_5)-CH_2-COOK$ (14)

$CF_3(CF_2)_7-SO_2-N(C_3H_7)-CH_2-COOK$ (15)

-continued $CF_3(CF_2)_6-CO-N(C_2H_5)-(CH_2)_2-SO_3K$ (16)

(17)

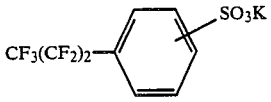

($SO_3K$ being attached in o-, m- or p- configuration) or mixture of such compounds (18)

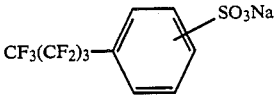

(as the same as above)

$CF_3(CF_2)_7-SO_3K$ (19)

$CF_3(CF_2)_{11}-CH_2-OSO_3Na$ (20)

$CF_3(CF_2)_6-COO-(CH_2)_3-SO_3Na$ (21)

$H(CF_2)_6-CH_2-O-(CH_2)_3-SO_3Na$ (22)

$CH_2-COOCH_2-(CF_2)_6-H$ (23)
$|$
$NaO_3S-CH-COOCH_2-(CF_2)_6-H$ $CH_2-COOCH_2-(CF_2)_6-H$ (24)
$|$
$NaO_3S-CH-COOCH_2-(CF_2CF_2)_2H$ $CHCO(OCH_2CH_2)_4OCHCOOCH_2CF_2CF_2H$ (25)
$|$ $|$
$CHCOOK$ $CH_2COOCH_2CF_2CF_2H$ $C_{16}H_{33}-CH(SO_3Na)-COOCH_2-CF_3$ (26)

$C_{16}H_{33}-CH(SO_3Na)-CONHCH_2-(CF_2)_2H$ (27)

$CF_3(CF_3)_7-SO_2-NHCH_2CH_2-\overset{\oplus}{N}(CH_2CH_3)_2-CH_2-COO^{\ominus}$ (28)

$CF_3-C(C_2F_5)_2-C(CF_3)-CHF-CH_3$ (29)
$|$
$CH_2O(CH_2CH_2O)_7H$ $CF_3-C(C_2F_5)_2-C(CF_3)-CHF-CF_3$ (30)
$|$
$COO(CH_2CH_2O)_4H$ $CF_3-C(C_2F_5)_2-C(CF_3)-CHF-CF_3$ (31)
$|$
$COONa$ $CF_3-C(C_2F_5)_2-CH(CF_3)-CF-COONa$ (32)

$CF_3-(CF_2)_7-SO_2-N(C_2H_5)-(CH_2)_2-O-(CH_2CH_2O)_{20}H$ (33)

$CF_3-(CF_2)-COO-(CH_2CH_2-O-)\ CH_3$ (34)

$H-(CF_2)_{16}-CH_2OH$ (35)

$H-(CF_2)_6-CH_2OH$ (36)

-continued $$CF_3(CF_2)_6-COO(CH_2-\underset{\underset{CF_3}{|}}{CH}.O)_4(CH_2CH_2O)_{20}H \quad (37)$$

$$CF_3(CF_2)_6COO(CH_2-\underset{\underset{CH_3}{|}}{CH}-O)_3(CH_2-CH_2-O)_{10}(CH_2)_4CH_3 \quad (38)$$

$$CF_3-(CF_2)_7-SO_2NH(CH_2)_3-\oplus N(CH_3)_3.I\ominus \quad (39)$$

(40)

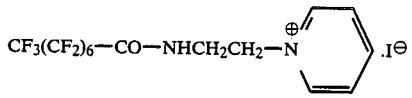

$$CF_3(CF_2)_6-CONH(CH_2)_3-\oplus N(CH_3)_2-CH_2CH_2COO\ominus \quad (41)$$

$$CF_3-(CF_2)_7-SO_2-\underset{\underset{CH_3}{|}}{N}-CH_2CH_2OSO_3H \quad (42)$$

(43)

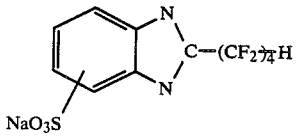

wherein the $SO_3Na$ group is attached in the 4- or 5-position or mixture of such compounds $$C_8F_{17}SO_2-\underset{\underset{C_2H_5}{|}}{N}-CH_2-CH_2-O-P(=O)(OH)_2 \quad (44)$$

$$H(CF_2)_8-O-P(=O)(ONa)_2 \quad (45)$$

$$CF_3(CF_2)_{12}-COO(CH_2CH_2O)_{20}-H \quad (46)$$

$$CF_3(CF_2)_6-CO-\underset{\underset{CH_3}{|}}{N}(CH_2)_2-O(CH_2CH_2O)-H \quad (47)$$

$$F(\underset{\underset{CF_3}{|}}{CF}-CF_2O)_2-\underset{\underset{CF_3}{|}}{CF}CONH(CH_2)_3N(CH_3)_2 \rightarrow O \quad (48)$$

$$(CH_3COO)_2CH(CF_2)CF_3 \quad (49)$$

(50)

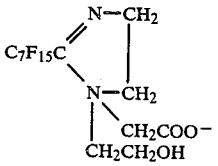

-continued (51)

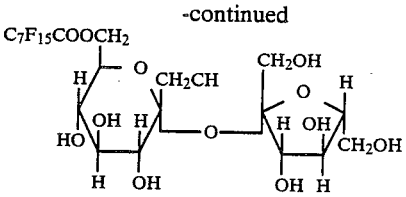

(52)

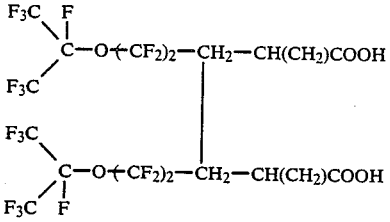

(53)

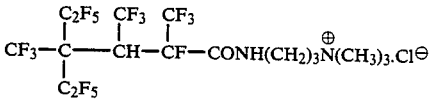

(54)

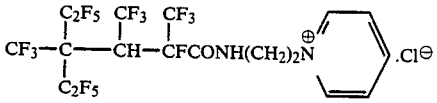

(55)

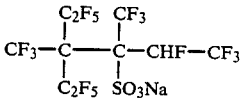

(56)

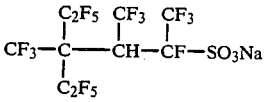

(57)

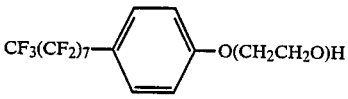

$$H(CF_2)_6-CH_2O(CH_2CH_2O)_{10}-H \quad (58)$$

$$H(CF_2)_6-CH_2O(CH_2CH_2O)_{20}-H \quad (59)$$

$$H(CF_2)_4-CH_2O(CH_2CH_2O)_5-H \quad (60)$$

$$H(CF_2)_6-CH_2O(CH_2\underset{\underset{OH}{|}}{C}HCH_2O)_5-H \quad (61)$$

$$H(CF_2)_6-CH_2O(CH_2\underset{\underset{OH}{|}}{C}HCH_2O)_2(CH_2CH_2O)_5-H \quad (62)$$

Particularly preferable organic fluorine-containing surface active agent for use in the present invention includes anionic organic fluorine-containing surface active agents.

The amount of the organic fluroine-containing surface active agent to be added is 0.1–500 mg, preferably 1–200 mg per $m^2$ of the non-light-sensitive hydrophilic colloid layer applied.

The non-light-sensitive hydrophilic colloid layer applied according to this invention may contain dispersed colloidal silver or colloidal silver in the form of fine particles which is not substantially developed as described, for example, in U.S. Pat. Nos. 3,050,391; 3,140,179 and 3,523,022.

The non-light-sensitive hydrophilic colloid layer of the present invention can be hardened with a hardening agent which has heretofore been known well. Examples of the hardening agent include, for example, diacetyl, ketone compounds such as dichloropentane dione, bis-(2-chloroethylurea), 2-hydroxy-4,6-dichloro-1,3,5-triazine, compounds having reactive halogen such as described in U.S. Pat. Nos. 3,288,775 and 2,732,303 and British Pat. Nos. 974,723 and 1,167,207, divinyl sulfone, 5-acetyl-1,3-diacryloylhexahydro-1,3,5-triazine and, in addition to the above compounds, those described in U.S. Pat. Nos. 3,635,718 and 3,232,763, British Pat. No. 994,869, U.S. Pat. Nos. 2,732,316; 2,586,168; 3,103,437; 3,117,280; 2,983,611; 2,725,294; 2,725,295; 3,100,704; 3,091,537; 3,321,313 and 3,54,292 can also be used.

When the non-light-sensitive hydrophilic colloid layer is applied, the surface active agent may be added either alone or in combination to one another. These surface active agents are applied with a view to improving a coating aid, emulsification and dispersion, sensitization and photographic characteristics, preventing electrification and preventing adhesion. These surface active agents are classified into natural surface active agents such as saponin; nonionic surface active agents such as alkylene oxide-, glycerin- and glycidol-series nonionic surface active agents; cationic surface active agents such as higher alkylamines, quaternary ammonium salts, pyridine, other heterocyclic compounds, phosphonium and sulfonium compounds; anionic surface active agents such as those containing an acid group as derived from carboxylic acid, sulfonic acid, phosphoric acid, sulfuric acid ester or phosphoric acid ester and amphoteric surface active agents such as amino acids, aminosulfonic acids, and sulfuric acid ester or phosphoric acid ester of aminoalcohol. Some of the above-mentioned surface active agents which can be used in this invention is described in U.S. Pat. Nos. 2,271,623; 2,240,472; 2,288,226; 2,739,891; 3,068,101; 3,158,484; 3,201,253; 3,210,191; 3,294,540; -48-15649; 3,441,413; 3,442,654, 3,475,174 and 3,545,974, German Pat. No. (OLS) 1,942,665, British Pat. Nos. 1,077,317 and 1,198,450. Further, the non-light-sensitive hydrophilic colloid layer can contain, if necessary, various photographic additives.

The light-sensitive material to be prepared according to this invention carries on a support at least one silver halide emulsion layer and all of the silver halide emulsion layer, support and auxiliary layers (such as antihalation layer, filter layer, inter layer, subbing layer, etc.) which are applied, if necessary, may be known ones.

The silver halide used according to the present invention in the emulsion layer of the light-sensitive material is in general dispersed as silver halide grains in a hydrophilic colloid, said silver halide being such as silver bromide, silver chlorobromide, silver iodobromide or silver chloroiodobromide and such silver halide being prepared according to various methods such as ammonia method, neutral method, acid method, so-called conversion method as described in British Pat. No. 635,841 and U.S. Pat. No. 3,622,318 or a simultaneous mixing method.

Further, as the hydrophilic colloid used for dispersing silver halide, the same binder as used for the non-light-sensitive hydrophilic colloid layer can be used.

The above silver halide emulsion can be chemically sensitized by an ordinary method. The chemical sensitizing agents include, for example, gold compounds such as chloroaurate or gold trichloride as illustrated in U.S. Pat. Nos. 2,399,083; 2,540,085; 2,597,856 and 2,597,915, salts of noble metal such as platinum, palladium, iridium, rhodium and ruthenium as illustrated in U.S. Pat. Nos. 2,445,060; 2,540,086; 2,566,245; 2,566,263 and 2,598,079, such sulfur compounds as forming silver sulfide in the reaction with a silver salt as described in U.S. Pat. Nos. 1,574,944; 2,410,689; 3,189,458 and 3,501,313, stannous salts as described in U.S. Pat. Nos. 2,487,850; 2,518,698; 2,521,925; 2,521,926; 2,694,637; 2,983,610 and 3,201,254, amines and other reductive substances.

Further, the silver halide photographic emulsion may be subjected, if necessary, to spectral sensitization or supersensitization, using cyanine dyes such as cyanine, merocyanine and carbocyanine alone or in combination or using such cyanine dye in combination with a styryl dye. These color sensitization methods have been known for a long time and are disclosed in U.S. Pat. Nos. 2,688,545; 2,912,329; 3,397,060; 3,615,635 and 3,628,964, British Pat. Nos. 1,195,302; 1,242,588 and 1,293,862, German Pat. Nos. (OLS) 2,103,326 and 2,121,780 and Japanese Patent Publication No. 43-4936 and No. 44-14030. The sensitization method can optionally be selected based on the wavelength part, speed to be sensitized as well as the object and use of the light-sensitive material.

To the above photographic emulsion, various compounds can be added in order to prevent lowering in the speed and fogging during the course of the preparation, preservation or during treatments. As such compounds, a quite number of compounds such as not only 4-hydroxy-6-methyl-1,3,3a,7-tetrazaindene, 3-methylbenzothiazole, 1-phenyl-5-mercaptotetrazole but also many heterocyclic compounds, mercury-containing compounds, mercapto compounds and metal salts have been known for a long time.

When the light-sensitive material according to this invention is made for color photography, a coupler as given below may be included into the light-sensitive material.

As the yellow coupler, an open-chain ketomethylene compounds have heretofore been used and further widely used a benzoylacetanilide type yellow coupler and a pivaloylacetanilide type yellow coupler can be used. Further, a 2-equivalent type yellow coupler in which the carbon at the coupling position is substituted with a substituent which can be split-off in the coupling reaction is also advantageously used. Examples of such yellow couplers are given in U.S. Pat. Nos. 2,875,057; 3,265,506; 3,664,841; 3,408,194; 3,447,928; 3,277,155 and 3,415,652, Japanese Patent Publication No. 49-13576, Japanese Patent L-O-P Publications No. 48-29432; No. 48-66834; No. 49-10736; No. 49-122335; No. 50-28834 and No. 50-132926. Magenta couplers which can be used in this invention include pyrazolone-, pyrazolotriazole-, pyrazolinobenzimidazole- and indazolone-series compounds. In the present invention, the following compounds are preferably used: as the pyrazolone magenta coupler, the compounds as described in U.S. Pat. Nos. 2,600,788; 3,062,653; 3,127,269; 3,311,476; 3,419,391, 3,519,429; 3,558,318; 3,684,514 and 3,888,680, Japanese Patent L-O-P Publications No. 49-29639; No. 49-111631; No. 49-129538; No. 50-13041 and No. 51-105820,; as the pyrazolotriazole magenta coupler, the compounds described in British Pat. No. 1,247,493 and Belgian Pat. No. 792,525; as the pyrazolinobenzimidazole magenta coupler, the compounds described in U.S. Pat. No. 3,061,432, German Pat. No. 2,156,111 and Japanese Patent Publication No. 46-60479; and further as the indazolone magenta coupler, the compounds described in Belgian Pat. No. 769,116.

As the cyan coupler used in this invention, phenol or naphthol derivatives are generally employed. Examples of these derivatives are described, for example, in U.S. Pat. Nos. 2,423,730; 2,474,293; 2,801,171; 2,895,826; 3,476,563; 3,737,316; 3,758,308 and 3,839,044, Japanese Patent L-O-P Publications No. 47-3742; No. 50-10135; No. 50-25228; No. 50-112038; No. 50-117422 and No. 50-130441.

In addition to the above couplers, a colored magenta coupler and a colored cyan coupler can also be used preferably in this invention. According to the present invention, a so-called DIR compound may be included in the silver halide emulsion layer. Further, according to this invention, any photographic additives such as a color fading inhibiting agent, an antistain agent, etc. may be included in the silver halide emulsion layer.

In the present invention, as the support on which the non-light-sensitive hydrophilic colloid layer, the silver halide emulsion layer and other auxiliary layers according to this invention are applied, there are used preferably, for example, a cellulose ester film such as cellulose nitrate, cellulose acetate, etc., a polyester film such as polyethylene terephthalate, etc., a polyvinyl acetal film, a polyvinyl chloride film, a polystyrene film, a polycarbonate film, a baryta paper and a polyethylene-coated paper.

In the present invention, selection of the method for coating the silver halide emulsion layer and other layers which constitute the light-sensitive material may suitablly be made to ensure evenness of quality and productivity. Such coating method can be selected from, for example, dip coating, double roll coating, air-knife coating, extrusion coating and curtain coating. Among the above methods, the extrusion coating and curtain coating which enable simultaneous coating of two or more layers are particularly useful. When coating, an appropriate coating speed can be selected but, from the viewpoint of the productivity, a speed of 30 m/min. or higher is preferable.

Further, with regard to materials which have rapid reactivity with gelation, it is preferred that they are added into a coating solution immediately before coating by means of a static mixer to avoid any adverse effects caused thereby before the coating. Such materials are for example, a hardening agent.

The light-sensitive material according to this invention may be any one for use in ordinary black and white photography, X-ray photography, printing photography, micro photography, electron beam recording photography, infrared ray recording photography and color photography.

When the light-sensitive material prepared according to the process of this invention is a light-sensitive color photographic material, such light-sensitive color photographic material as having 3 silver halide emulsion layers showing different color-sensitivities from one another is mentioned as the representative example thereof.

Said three different color-sensitivities include red-sensitivity, green-sensitivity and blue-sensitivity. These silver halide emulsion layers showing different color-sensitivities are applied successively, if necessary, through an inter layer or the like. In such case, a light-sensitive material in which the non-light-sensitive hydrophilic colloid layer of this invention is applied after or at the same time as the application of the silver halide emulsion layer showing sensitivity to a single color on the support is effective for the object of this invention and also a light-sensitive material in which the non-light-sensitie hydrophilic colloid layer of the present invention is applied on the silver halide emulsion layers showing sensitivities to two different colors is similarly effective for the object of this invention.

Typical light-sensitive multi-layer color material prepared according to the process of this invention is one wherein, for example, a red-sensitive silver halide emulsion layer, a green-sensitive silver halide emulsion layer, a blue-sensitive silver halide emulsion layer and a non-light-sensitive hydrophilic colloid layer are applied on the support, if necessary, through a subbing layer, a filter layer and an inter layer.

The light-sensitive material according to the present invention can present an image after exposure, by means of the processing depending upon the use as it is usually used of the light-sensitive material for use in ordinary black and white photography, microphotography, lith-type photography, printing paper and color photography. The basic steps for the photographic processing comprise development and fixing, and, if necessary, further processings such as hardening, stopping, bleaching and stabilization can be added.

As the developing solution used for the development, there may be used an ordinary black and white developing solution and such developing solution contains a developing agent such as hydroquinone, aminophenol and phenidone and in addition, if necessary, an alkali agent such as sodium hydroxide and sodium carbonate, a constancy-maintaining agent such as sodium sulfite, a pH buffer, a development accelerator, a development inhibitor, a surface active agent, etc. may be contained.

The fixing solution used for the fixing contains a solvent for the silver halide which solvent is, for example, thiosulfate such as sodium thiosulfate, ammonium thiosulfate, and if necessary, various additives may be contained. When a particular reference is directed to the processing of light-sensitive color material, the basic processing procedure according to the negative-positive method comprises color development, bleaching and fixing. Alternatively, the basic processing procedure of the reversal method comprises development with a black and white negative developing solution and then exposure to white light- or processing with a bath containing a fogging agent and thereafter color development, bleaching and fixing. Each of the above basic processing procedures may be effected independently or alternatively, two or more processings may be replaced by a single processing using such processng solution as having simultaneously both the functions of said processings. This type of processing is, for example, the monobath color processing as described in Japanese Patent Publication No. 35-1885, wherein said monobath contains a color developing agent, a ferric salt bleaching component and a thiosulfate fixing component or a monobath bleach-fixing method wherein said monobath contains an ethylenediaminetetraacetic acid iron (III) complex bleaching component and a thiosulfate fixing component.

There is no particular limitation on the method for processing of the light-sensitive color material of the present invention and any method for processing can be applied according to the purpose. As the typical methods, for example, the following methods are included: A method in which after color development, bleaching and fixing are effected and, if necessary, further washing with water and stabilization are effected, as described in U.S. Pat. No. 3,582,322; a method in which after color development, bleaching and fixing are effected separately and, if necessary, further washing with water and stabilization are effected, as described in U.S. Pat. No. 910,002; a method in which pre-hardening, neutralization, color development, stop-fixing, washing with water, bleaching, fixing, washing with water, post-hardening and washing with water are effected in this order, as described in U.S. Pat. No. 3,582,347; a method in which color development, washing with water, complementary color development, stopping, bleaching, fixing, washing with water and stabilization are effected in this order, as described in Japanese Patent L-O-P Publication No. 50-54330; a method in which pre-hardening, neutralization, washing with water, first development, stopping, washing with water, color development, stopping, washing with water, bleaching fixing and washing with water are effected in this order, as described in U.S. Pat. No. 3,607,263; a method in which pre-hardening, neutralization, first development, stopping, washing with water, color development, stopping, washing with water, bleaching, organic acid-bath treatment, fixing and washing with water are effected in this order, as described in Japanese Patent L-O-P Publication No. 50-36126; a method in which first development, non-fixative silver dye bleaching, washing with water, color development, acid-rinsing, washing with water, bleaching, washing with water, fixing, washing with water, stabilization and washing with water are effected in this order, as described in Japanese Patent L-O-P Publication No. 50-81538; a method for development in which after being subjected to halogenation-bleaching, developed silver resulting from color development is further color-developed again to increase the resulting quantity of dye, as described in U.S. Pat. Nos. 2,623,822 and 2,814,565; and a method for processing a light-sensitive material of low silver content by using an amplifier agent such as a peroxide or cobalt complex, as described in U.S. Pat. Nos. 3,674,990 and 3,761,265, German Pat. No. (OLS) 2,056,360, Japanese Patent L-O-P Publications Nos. 47-6338 and 47-10538, German Pat. No. (OLS) 2,226,770, Japanese Patent L-O-P Publications No. 48-9728 and No. 48-9729. Any method of the above may be used for the processing of the present light-sensitive material. The above processing are carried out in some cases at a high temperature above 30° C. in order to achieve rapid processing, or at room temperature or, in particular case, at a temperature below 20° C. In general, it is convenient to carry out the processings at a temperature within the range of 20° C.–70° C. Further, the temperature for each step of the successive processings may be the same or different.

As the color developing agent, p-phenyldiamine and aminophenol color developing agents are typical and preferable examples include the following compounds:

4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaninline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxyethylamino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-(β-(β-methoxyethoxy)ethoxy)ethyl-3-methyl-4-aminoaniline, N-ethyl-N-β-(β-methoxyethoxy)ethyl-3-methyl-4-aminoaniline and salts thereof, for example, sulfate, hydrochloride, sulfite, p-toluenesulfonate, etc. Further, the compounds as described in Japanese Patent L-O-P Publications No. 48-64932 and No. 50-131527, Japanese Patent Application No. 50-17246 and Bent's Journal of the American Chemical Society, 73, 3100–3125 (1951).

If necessary, various additives can be added to the color developing solution. Typical examples of such additives include alkali agents (for example, hydroxide, carbonate and phosphate of alkali metal or ammonium), pH adjusting agents or buffers (for example, weak acids such as acetic acid or boric acid, weak bases and salts thereof ), development accelerators (for example, various pyridinium compounds and cationic compounds, potassium nitrate and sodium nitrate as described in U.S. Pat. Nos. 2,648,604 and 3,571,247; polyethyleneglycol condensate and its derivatives as described in U.S. Pat. Nos. 2,533,990; 2,577,127 and 2,950,970; nonionic compounds such as polythioethers as described in British Pat. Nos. 1,020,032 and 1,020,033; polymer compounds having sulfite esters as described in U.S. Pat. No. 3,068,097; and other pyridines, ethanolamines, organic amines, benzyl alcohol and hydrazines); anti-fogging agents (for example, in addition to alkali bromide, alkaliiodide and nitrobenzimidazoles as described in U.S. Pat. Nos. 2,496,940 and 2,656,271, mercaptobenzimidazole, 5-methylbenzotriazole, 1-phenyl-5-mercaptotetrazole; compounds for use in rapid processing solution, as described in U.S. Pat. Nos. 3,113,864; 3,342,596; 3,295,976; 3,615,522 and 3,597,199; nitrobenzoic acid as described in Japanese Patent L-O-P Publication No. 49-106832; benzothiazolium derivatives as described in Japanese Patent L-O-P Publication No. 50-1371136; phenazine N-oxides as described in Japanese Patent Publication No. 46-41675 and other antifogging agent as described in "Scientific Photograph Handbook" second volume, pages 29–47); antistain or antisludge agent as described in U.S. Pat. Nos. 3,161,513 and 3,161,514; British Pat. Nos. 1,030,442; 1,144,481 and 1,251,558; and superposed-layer-effect accelerators and constancy-maintaining agents (for example, sulfite, bisulfite, hydroxylamime hydrochloride, formsulfite, alkanolamine sulfite addition product) as described in U.S. Pat. No. 3,536,467.

When the present invention is applied to a light-sensitive color materials, the bleaching processing is effected in an ordinary manner, following to the color development. The bleaching processing may be effected either at the same time as or separately from fixing. The processing solution used for the bleacing can be made a bleaching and fixing bath by adding thereto, if necessary, a fixing agent.

Various compounds can be used as the bleaching agent, and among them, typical examples include potassium ferricyaninde, bichromate, iron (III) aminopolycarboxylic acid, aliphatic polycarboxylic acid metal salt, persulfate, copper complex as described in British Pat. Nos. 774,194; 1,032,024 and 949,440, and Belgian Pat. No. 717,139, cobalt complex as described in German Pat. No. 934,512 and British Pat. No. 777,635, iodine as described in Japanese Patent Publication No. 41-11068, bleaching powder and sulfamic acid as described in Japanese Patent Publication No. 41-11068, quinones as described in U.S. Pat. Nos. 2,507,183;

2,529,981 and 2,748,000, and p-sulfophenylquinones or nitron compounds as described in U.S. Pat. Nos. 2,625,477 and 2,705,201, which are used alone or in an appropriate combination.

Further, to the bleaching or bleach-fixing solution, there can be added, in addition to the bleaching accelerators as described in U.S. Pat. Nos. 3,042,520 and 3,241,966 and Japanese Patent Publications No. 45-8506 and No. 45-8836, various additives.

The present invention will be explained further in detail by way of the following Examples without any intention of limiting the embodiments of this invention thereto:

EXAMPLE 1

To a high speed X-ray silver iodobromide emulsion (containing 2 mol% of silver iodide) which has been prepared and contained 60 g of gelatin per mol of silver halide were added 4-hydroxymethyl-1,3,3a,7-tetrazaindene as a stabilizer, saponin as a coating aid and mucochloric acid as a hardening agent. Together with this emulsion, as a protective layer, a gelatine solution which contains a dispersion solution A which will be explained later, a mucochloric acid, a matting agent and a coating aid was applied so that the compositions as defined in Table 1 below may be achieved according to the slide-hopper process on a subbed polyester film support in the succession from the support of the silver halide emulsion layer, a lower protective layer and an upper protective layer at the coating speed of 50 m/min. in such manner that the above three layers are superposed and coated at the same time.

Dispersion solution A

In 48 g of tricresyl phosphate and 48 g of ethyl acetate were dissolved 24 g of the compound (A) (UV absorber) having the structural formula

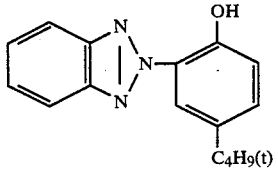

by heating to 65° C. (The compound (A) is commercially available as Tinuvin Ps (product of Ciba-Geigy Limited).

The solution was added to 400 cc of 5% aqueous gelatine solution containing 4.0 g of sodium dodecylbenzenesulfonate which has been heated to 50° C. with stirring and subsequently passed through a colloid mill five times to give the dispersion solution A.

TABLE 1

| | Sample No. | 1 | 2 | 3 | 4 |
|---|---|---|---|---|---|
| Upper protective layer | binder | gelatin 1.4 g/m² | | gelatin 0.7 g/m² | |
| | amount of oil drop in dispersion solution A (g/m²) | 0.36 | 0 | 0.18 | 0.36 |
| | coating aid | surface active agent (1) (Note 3) 2 g/100 g of binder | | | |
| | matting agent | polymethyl methacrylate particle (average particle diameter: 4μ) 2 g/100 g of binder | | | |
| Lower protective layer | binder | (Note 1) gelatin 0.7 g/m² | | | |
| | amount of oil drop | | 0.36 | 0.18 | 0 |

TABLE 1-continued

| | Sample No. | 1 | 2 | 3 | 4 |
|---|---|---|---|---|---|
| | in dispersion solution A (g/m²) | | | | |
| | coating aid | saponin 15 g/100 g of binder | | | |
| Oil Particle Density (Note 2) oil/binder | upper protective layer | 0.35 | 0 | 0.35 | 0.7 |
| | lower protective layer | 0 | 0.7 | 0.35 | 0 |

(Note 1) Sample 1 does not contain the lower protective layer and so constituted by a single layer.

(Note 2) In the calculation of the oil particle density, the specific gravity of gelatine was defined as 1.35 and that of a component dissolved in oil was defined as 1.0 (this definition being similarly applied to the following Examples).

(Note 3) The surface active agent (1) is sodium di-2-ethylhexylsulfosuccinate.

After drying, the coated samples No. 1–4 were cut off into two sheets of 5 cm²of size, respectively, and then maintained for one day under the atmosphere of 40° C. and 80% RH (RH means relative humidity), while keeping not contacting to one another. Thereafter, the protective layers of the same sample were brought into contact to each other subjected to 800 g of load and then maintained under the atmosphere of 40° C. and 80% RH. Subsequently, the sample was stripped off and the area of the adhesion portion was measured.

Results obtained are shown in Table 2. The evaluation was made according to the following ratings:

Rank A: area of the adhesion portion 0–20%
Rank B: area of the adhesion portion 21–40%
Rank C: area of the adhesion portion 41–60%
Rank D: area of the adhesion portion 61–80%
Rank E: area of the adhesion portion more than 81%

TABLE 2

| | Result of Adhesion Test | | | |
|---|---|---|---|---|
| Sample No. | 1 | 2 | 3 | 4 |
| Adhesion test rating | C | A | C | E |

From the result of Table 2, it is apparent that the adhesion is particularly improved according to the present process (as shown by the result of Sample No. 2), in spite of the addition of such oil particle as container the equivalent amounts of the binder and the UV absorber per unit area.

EXAMPLE 2

On a cellulose triacetic base, the following superposed coating-drying steps were repeated according to the slide-hopper process to form a high speed multilayer color negative film.

First step:

On the subbed cellulose triacetate base, an antihalation layer containing black colloidal silver (thickness of dried layer: 1μ) and a gelatin inter layer containing 2,5-di-tert octylhydroquinone (thickness of dried layer: 1μ) were coated according to simultaneous two-layer superposition as the first layer and the second layer, respectively, at 50 m/min. of coating speed. After drying, the film was rolled up with a roller.

Second step:

On the coating of the first step, there were coated according to simultaneous two-layer superposition, a red-sensitive silver iodobromide emulsion layer, i.e. the silver iodobromide emulsion layer containing 8 mol% of silver bromide, (thickness of dried layer: 6μ) as a third layer which contains per mol of silver halide, as a cyan coupler, $6.8\times10^{-2}$ mol of 1-hydroxy-N-{Y-(2,4-di-tert amylphenoxy)butyl}-2-naphthamide, as the colored coupler, $1.7\times10^{-2}$ mol of 1-hydroxy-N-{σ-(2,4-di-tert amylphenoxy)butyl}-4-(2-ethoxycarbonylphenylazo)-2-naphthamide and as a developer inhibitor releasing material, $4\times10^{-3}$ mol of 2-(1-phenyl-5-tetrazolylthio)-4-(2,4-di-tert amylphenoxyacetamido)-1-indanone, and an inter layer having the same composition as the above second layer as a fourth layer in the similar manner at 40 m/min. of coating speed, and the resulting film was rolled up.

Third step:

On the coating which has passed through the second step, there were coated according to simultaneous superposition four layers in total comprising a green-sensitive low speed silver iodobromide emulsion layer, i.e. silver iodobromide emulsion layer containing 8 mol% of silver iodide (thickness of dried layer: 3.5μ) as a fifth layer which contains, per mol of silver halide, as a magneta coupler, $5.8\times10^{-2}$ mol of 1-(2,4,6-trichlorophenyl)-3-{3-(α-(2,4-di-tert amylphenoxy)-acetamido)-benzamido}-5-pyrazolone, as a colored coupler, $1.7\times10^{-2}$ mol of 1-(2,4,6-trichlorophenyl)-3-{3-(3-(octadecenylsuccinimido)-2-chloro)anilido-4-(Y-naphthylazo)}-5-pyrazolone and as a developing inhibitor releasing material, $7\times10^{-3}$ mol of 2-(1-phenyl-5-tetrazolylthio)-4-(2,4-di-tert amylphenoxyacetamido)-1-indanone; a green sensitive high speed silver iodobromide emulsion layer, i.e. silver iodobromide emulsion layer containing 6 mols of silver iodide (thickness of dried layer: 2.5μ) as a sixth layer which contains, per mol of silver halide, the same compounds as the magenta coupler, the colored coupler and the developing inhibitor releasing material in the fifth layer, respectively in the amount of $1.1\times10^{-2}$ mol, $5\times10^{-3}$ mol and $2\times10$ mol, respectively; an inter layer having the same composition as the second layer as a seventh layer and a gelatin layer (thickness of dried layer: 1μ) as the eighth layer, which contains yellow colloidal silver and 2,5di-tert octylhydroquinone at 40 m/min. of coating speed, and the resulting film was rolled up with a roller.

Fourth step:

On the coating which has passed through the third step, there were coated according to simultaneous three-layer superposition a blue-sensitive silver iodobromide emulsion layer for color photography (silver iodide content: 7 mol%) as a ninth layer, which contains per mol of silver halide 300 g of gelatin, as the yellow coupler, $2.5\times10^{-2}$ mol of α-pivaloyl-α-(1-benzyl-2,4-di-oxyimidazoline-3-yl-2-chloro-5(Y-(2,4-tert amylphenoxy)butylamido)acetanilide, as a developing inhibitor releasing material, $5\times10^{-2}$ mol of ω-bromo(1-phenyl-5-tetrazolylthio)-4-lauroylamidoacetphenone and as a hardening agent, 1,2-bis(vinylsulfonyl)ethane and as tenth and eleventh layers as a solution containing dispersion solutions B to E which have been dispersed in the manner as mentioned below and the hardening agent as defined above so that the composition as defined in Tables 3 and 4 may be achieved, at 40 m/min of coating speed, and then dried.

After drying, the dried layer thickness of the ninth layer was about 6μ and the dried layer thickness of the combination of the tenth layer and the eleventh layer was about 1.4μ.

TABLE 3

| | Component composition and organic fluorine-containing active agent | | Type A | Type B |
|---|---|---|---|---|
| Upper protective layer (eleventh layer) | binder | | gelatin 0.64 g/m² | |
| | amount of oil drop contained in dispersion solution (g/m²) | | 0.05 | 0.38 |
| | coating aid | | surface active agent (1) 2 g/100 g of binder | |
| | matting agent | | silica having 3.3μ of average particle diameter 3 g/100 g of binder | |
| Lower protective layer (tenth layer) | binder | | gelatin 0.64 g/m² | |
| | amount of oil drop contained in dispersion solution (g/m²) | | 0.38 | 0.05 |
| | coating aid | | saponin 1.5 g/100 g of binder | |
| | Oil particle Density oil/binder | upper protective layer | 0.1 | 0.8 |
| | | lower protective layer | 0.8 | 0.1 |

Note: The surface active agent (1) is the same as that used in Example 1.

TABLE 4

| | Sample No. | Construction of Sample 5 | 6 | 7 | 8 | 9 | 10 | 11 | 12 | 13 | 14 |
|---|---|---|---|---|---|---|---|---|---|---|---|
| Protective layers (the tenth and eleventh layers) | type (according to classification of Table 3) | A | B | A | B | A | B | A | B | A | B |
| | type of dispersion solution | B | | C | | D | | E | | E | |
| | | All the first to nineth layers are common in each sample. | | | | | | | | | |

The upper protective layer of the Sample No. 13 or No. 14 contains exemplified compound (23) as the organic fluorine-containing surface active agent in the proportion of 0.7 g/100 g of binder.

Dispersion solution B:

24 g Of dioctyl phthalate and 6 g of ethyl acetate were dissolved by mixing at 65° C. and the resulting solution was added with stirring to 100 cc of an aqueous 5% gelatin solution containing 1 g of sodium tri-isopropylnaphthalenesulfonate which has been heated to 50° C., and then dispersed by being passed through a colloid mill five times to give the dispersion solution B.

Dispersion solution C:

The process for the preparation of the dispersion solution B was repeated, excepting the use of tricresyl phosphate in place of the dioctyl phthalate in the dispersion solution B but in the same amount to give the dispersion solution C.

Dispersion solution D:

9 g of 2,5-di-tert octylhydroquinone were dissolved in 15 g of dioctyl phthalate and 6 g of ethyl acetate by heating to 65° C. The resulting solution was added with stirring to 100 cc of an aqueous 5% gelatin solution containing 1 g of sodium tri-isopropylnaphthalenesulfonate which has been heated to 50° C., and then passed through a colloid mill five times to give the dispersion solution D.

Dispersion solution E:

The process for the preparation of the dispersion solution D was repeated, excepting the use of 9 g of a mixture of compounds (A), (B), (C) and (D) as defined below (mixing ratio of compound (A): compound (B): compound (C): compound (D)=2:1:1: (1) in place of 2,5-di-tert octylhydroquinone in the dispersion solution (D) to give the dispersion solution (E).

Compound (B):

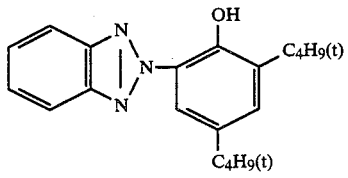

Compound (C):

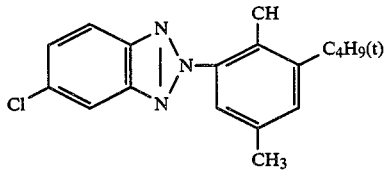

Compound (D):

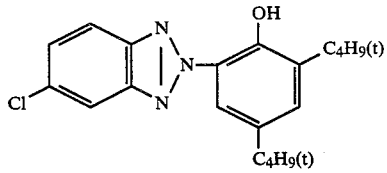

(Compound (A) is the same compound as that used in Example 1, and the compound (B), compound (C) and compound (D) are commercially available as Tinuvin-320, Tinuvin-326 and Tinuvin-327 (products of Ciba-Geigy Limited), respectively.)

The protective layers of Samples 13 and 14, contain exemplified compound (23) as a organic fluorine-containing surface active agent in the proportion of 0.7 g/100 g of binder.

Each of Samples 5 to 14 was cut off into two sheets of 5 $cm^2$ in size and maintained for one day under the atmosphere of 40° C. and 80% RH. Thereafter, the surfaces of the protective layers of the same type of samples were brought into contact to each other, subjected to 800 E of load and then maintained under the atmosphere of 40° C. and 80% RH. Then, the samples were split-off and the area of the adhesion portion was evaluated according to the rating as shown in Example 1.

Further, two test pieces (3.5×14 cm) of Samples 5 to 14 were treated according to the following procedures, while being unexposed, and after drying, one piece of each sample was maintained for 3 days under the atmosphere of 70° C. and 80% RH:

| Processing (38° C.) | Processing Time |
|---|---|
| color development | 3 min. 15 sec. |
| bleaching | 6 min. 30 sec. |
| washing with water | 3 min. 15 sec. |
| fixing | 6 min. 30 sec. |
| washing with water | 3 min. 15 sec. |
| stabilization | 1 min. 30 sec. |

The composition of the processing solution used in each of the above processing was as follows: Composition of color developing solution:

4-amino-3-methyl-N-ethyl-N-(β-hydroxyethyl)-aniline sulfate: 4.75 g
anhydrous sodium sulfite: 20 g
hydroxylamine.1/1 sulfate: 37.5 g
anhydrous potassium carbonate: 37.5 g
potassium bromide: 1.3 g
nitrilotriacetic acid.3 sodium salt (monohydrate): 2.5 g
potassium hydroxide: 1.0 g
water to make up 1 liter, pH being adjusted to 10.0.

Composition of bleaching solution:

ethylenediaminetetraacetic acid iron ammonium salt: 100.0 g
ethylenediaminetetraacetic acid 2-ammonium salt: 10.0 g
ammonium bromide: 150.0 g
glacial acetic acid: 10.0 g
water to make up 1 liter,
pH being adusted to 6.0.

composition of fixing solution:

5% aqueous ammonium thiosulfate solution: 162 ml
anhydrous sodium thiosulfite: 12.4 g
water to make up 1 liter,
pH being adjusted to 6.5.

Composition of stabilizing bath:

37% aqueous formalin solution: 5.0 ml
Konidax (product of Konishiroku Photo Industry Co., Ltd.): 7.5 g
water to make up 1 liter.

The tubidity of a sample after being maintained and, as comparison, the tubidity of a sample at the same day were measured by means of the turbidimeter manufactured by Nihon Seimitsu Kogakusha, and the results obtained are shown in Table 5.

TABLE 5

| | | Results of Evaluation | | | | | | | | | |
|---|---|---|---|---|---|---|---|---|---|---|---|
| Sample No. | | 5 | 6 | 7 | 8 | 9 | 10 | 11 | 12 | 13 | 14 |
| Adhesion test rating | | B | D | B | D | B | E | B | E | A | C |
| Turbidity (%) | on the same day | 10.2 | 9.8 | 11.5 | 11.2 | 12.1 | 11.8 | 12.6 | 11.3 | 11.2 | 11.0 |
| | after 3 days under 70° C. | 15.3 | 69.3 | 16.1 | 68.2 | 14.6 | 76.0 | 16.3 | 85.1 | 13.8 | 65.8 |

TABLE 5-continued

| Sample No. | Results of Evaluation 5 | 6 | 7 | 8 | 9 | 10 | 11 | 12 | 13 | 14 |
|---|---|---|---|---|---|---|---|---|---|---|
| and 80% RH | | | | | | | | | | |

In the Table 5, the less the difference between the turbidity on the same day and that after storage, the better the transparency.

From the results of Table 5, it is apparent that the samples according to the present invention attain excellent effect even in various dispersion solutions. Further, it is noted that the adhesion can be more improved by the joint use of the organic fluorine-containing surface active agent.

Furthermore, when exemplified compound (17) or (24) was used in Sample 13 in place of exemplified compound (23) as the organic fluorine-containing surface active agent in the same amount as compound (23), the similar results as that obtained with exemplified compound (23) was obtained.

EXAMPLE 3

As a fourth step, on the coating which has been passed through the third step in Example 2, there were coated according to simultaneous three-layer superposition, as a ninth layer, a blue-sensitive silver iodobromide emulsion layer (silver iodide content: 7 mol%) which contains per mol of silver halide 350 g of gelatin, as a yellow coupler, $3\times10^{-1}$ mol of α-pivaloyl-α-(1-benzyl-2-phenyl-3,5-dioxotriazine-4-yl)-5'-[α-(2,4-ditert amylphenoxy)butylamido]-2'-chloroacetanilide and as a hardening agent, 1,2-bis-(vinylsulfonyl)-ethane, and as tenth and eleventh layers, a gelatin solution which contains the dispersion solution E as described in Example 2 and exemplified compound (23) as a organic fluorine-containing surface active agent and, if necessary, the above hardening agent so that the composition as defined in Table 6 and Table 7 may be achieved at 40 m/min. of coating speed, and thereafter dried.

After drying, the dried layer thickness of the ninth layer was about 6μ and the combined layer thickness of the tenth layer and eleventh layer was about 1.4μ.

TABLE 6

Component composition of the tenth layer and eleventh layer other than organic fluorine-containing surface active agent

| | Type C | Type D | Type E |
|---|---|---|---|
| Upper protective layer (the eleventh layer) | | | |
| binder | | gelatin 0.64 g/m$^2$ | |
| amount of oil drop contained in dispersion solution E (g/m$^2$) | 0.05 | 0.25 | 0.45 |
| coating aid | | surface active agent (2) 3 g/100 g of binder | |
| matting agent | | silica having 3μ of average particle diameter 3 g/100 g of binder | |
| Lower protective layer (the tenth layer) | | | |

TABLE 6-continued

Component composition of the tenth layer and eleventh layer other than organic fluorine-containing surface active agent

| | Type C | Type D | Type E |
|---|---|---|---|
| binder | | gelatin 0.64 g/m$^2$ | |
| amount of oil drop contained in dispersion solution E (g/m$^2$) | 0.45 | 0.25 | 0.05 |
| coating aid | | saponin 1.5 g/100 g of binder | |
| Oil particle Density oil/binder | | | |
| upper protective layer | 0.11 | 0.53 | 0.95 |
| lower protective layer | 0.95 | 0.53 | 0.11 |

Note:
The surface active agent (2) is the compound of the formula

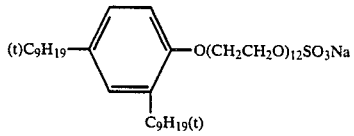

TABLE 7

| | Sample No. | 15 | 16 | 17 | 18 | 19 | 20 | 21 | 22 | 23 |
|---|---|---|---|---|---|---|---|---|---|---|
| Protective layer (the tenth and eleventh layers) | organic F-containing surface active agent added to the eleventh layer (exemplified compound (23)) | | 0 | | 0.4 g/100 g binder | | | 0.8 g/100 g binder | | |
| | type (according to the classification as defined in Table 6) | C | D | E | C | D | E | C | D | E |

The first to ninth layers are common.

Samples 15 to 23 were cut off into two sheets of 5 cm$^2$ in size, respectively, and maintained for one day under the atmosphere of 40° C. and 80% RH. Thereafter, the protective layers of the same type were brought into contact to each other, subjected to 800 g of load and then maintained under an atmosphere of 40° C. and 80% RH. Then, the samples were peeled apart and the area of the adhesion portion was measured according to the rating as defined in Example 1.

Further, a raw sample of each sample was maintained under an atmosphere of 40° C. and 80% RH for 7 days and thereafter further maintained together with a comparative sample under an atmosphere of 23° C. and 55% RH. These samples were measured on the peeling electrification quantity against neoprene rubber. Results obtained are given in Table 8.

TABLE 8

| Sample No. | | Results of Evaluation 15 | 16 | 17 | 18 | 19 | 20 | 21 | 22 | 23 |
|---|---|---|---|---|---|---|---|---|---|---|
| Adhesion test rating | | B | D | E | A | B | D | A | B | C |
| Feeling electrification quantity (pico | on the same day | +995 | +980 | +1020 | −300 | −45 | +220 | −550 | −280 | −55 |
| | after 7 days under 40° C. and 80% RH | +800 | +780 | +820 | −285 | +320 | +750 | −525 | −35 | +380 |

TABLE 8-continued

| Sample No. | Results of Evaluation 15 | 16 | 17 | 18 | 19 | 20 | 21 | 22 | 23 |
|---|---|---|---|---|---|---|---|---|---|
| coulomb/cm$^2$) | | | | | | | | | |

It is known that a value of the peeling electrification quantity moves towards the negative side by the addition of organic fluorine-containing surface active agent (23). However, from the results as shown in Table 8, it is noted that efficiency for use of the organic fluorine-containing surface active agent is increased by using it in the process of this invention and a less quantity of the organic fluorine-containing surface active agent used is sufficient for obtaining the same peeling electrification quantity value (the comparison between Sample 18 and Sample 22 referred to).

Further, it appears that according to the process of this invention, the extent of variation of the peeling electrification quantity during the storage under a high temperature and a high humidity is narrow and the electrification characteristics with time is stable.

EXAMPLE 4

On the high speed multi-layer negative superposed coating for color photography which has been completed up to the second step as described in Example 2 (coating having been completed up to the fourth layer), fifth to ninth layers were coated by simultaneous superposition according to the slide-hopper process at 40 m/min. of coating speed.

Construction of each of the seventh to ninth layers is shown in Table 9.

The fifth and sixth layers will be explained later.

TABLE 9

| | Construction of Layer | Sample No. 24 | 25 | 26 | 27 |
|---|---|---|---|---|---|
| the ninth layer | inter layer | — | — | II | IV |
| the eigth layer | yellow filter layer | I | III | II | II |
| the seventh layer | inter layer | V | I | III | I |

The first to sixth layers are common
Note:
(1) Dried layer thickness of the fifth layer was 3.5μ and dried layer thickness of the sixth layer was 2.5μ.
(2) The thicknesses of layers after drying of the seventh, eight and ninth layers were 0.8μ, respectively.
(3) Samples 24 and 25 do not contain the inter layer of the ninth layer.

Note: (1) Dried layer thickness of the fifth layer was 3.5μ and dried layer thickness of the sixth layer was 2.5μ.

(2) The thicknesses of layers after drying of the seventh, eighth and ninth layers were 0.8μ, respectively.

(3) Samples 24 and 25 do not contain the inter layer of the ninth layer.

In Table 9, the fifth and sixth layers are the same as the fifth and sixth layers in Example 2, respectively and yellow filter layers (I), (II) and (III) and inter layers (I), (II), (III), (IV) and (V) will be defined below.

Yellow filter layer (I):

A layer obtained by coating an aqueous 4% gelatin solution containing yellow colloidal silver and as an antistatic agent, an organic fluorine-containing surface active agent, i.e. exemplified compound (23) in an amount of 0.7 g/100 g of gelatin.

Yellow filter layer (II):

A layer obtained by coating an aqueous 4% gelatin solution containing yellow colloidal silver and dispersion solution D as described in Example 2 in an amount of oil particle of 10 g/100 g of gelatin.

Yellow filter layer (III):

The same as the yellow filter layer (II), excepting that dispersion solution D is contained in an amount of oil particles of 70 g/100 g of gelatin and exemplified compound (23) as an organic fluorine-containing surface active agent in an amount of 0.7 g/100 g of gelatin.

Inter layer I:

A gelatin layer.

Inter layer II:

A gelatin layer containing, in addition to said inter layer I, exemplified compound (23) as an organic fluorine-containing surface active agent in an amount of 0.7 g/100 g of gelatin.

Inter layer III:

A layer obtained by coating an aqueous 4% gelatin solution which contains dispersion solution D in an amount of oil particle of 60 g/100 g of gelatin.

Inter layer IV:

A layer obtained by coating an aqueous 4% gelatin solution which contains, in addition to said inter layer III, exemplified compound (23) as an organic fluorine-containing surface active agent in an amount of 0.7 g/100 g of gelatin.

Inter layer V:

A layer obtained by coating an aqueous 4% gelatin solution which contains dispersion solution D in an amount of oil particle of 70 g/100 g of gelatin is coated.

Samples 24 to 27 which have been coated and dried were rolled up in rollers having the same diameter, respectively, each in the length of 500 m, and then allowed to stand for one month under an atmosphere of 30° C. and 80% RH. From each of the samples thus allowed to stand, a further sample was assembled from the portion near the core of each roller in 1 m. The area of the glossy surface brought about by the adhesion between the surface of the emulsion layer and the back surface of the base was evaluated according to the rating as defined in Example 1.

Alternatively, the sample rolled up in the roller having the same diameter was maintained for one month under an atmosphere of 25° C. and 40% RH and then under the same condition, a blue-sensitive layer and a protective layer were coated according to simultaneous superposition at 80 m/min. of coating speed.

The blue-sensitive layer was common in each layer and the same as the blue-sensitive layer in Example 3 and the protective layer was a gelatin layer containing per 100 g of gelatin, as the matting agent, 3 g of silica having 3.3μ of average particle size and as the coating aid, 2 g of surface active agent (1).

Each sample, after being dried, was subjected to the photographic processings as defined in Example 2, and the area where a peeling static mark was formed on the coating of the blue-sensitive layer was evaluated according to the following rating and the results are shown in Table 10 together with adhesion test rating:

Static mark rating rank:

Rank A: no formation of static mark

Rank B: less than 30% of static mark formation

Rank C: 31–70% of static mark formation
Rank D: more than 71% of static mark formation

TABLE 10

| Sample No. | Results of Evaluation 24 | 25 | 26 | 27 |
|---|---|---|---|---|
| Adhesion test rating | A | C | A | B |
| Static mark | A | D | A | C |

It is apparent that in spite of that the same quantity of the organic fluorine-containing surface active agent is added as the antistatic agent, the inhibition effect for the formation of static mark is increased and the adhesion properties is outstandingly improved by using the process of this invention.

What is claimed is:

1. A process for the preparation of a light-sensitive silver halide photographic material comprising a support, a silver halide emulsion layer, and a non-light-sensitive hydrophilic colloid layer consisting essentially of two layer elements, said process comprising incorporating an oil particle-forming substance into at least one of said elements, the density of the oil particles of the outermost layer element being not more than 0.3 cc/cc, the oil particle density of the second of said layer elements being greater than the oil particle density of said outermost layer element, the difference in oil particle density between the outermost layer element and the second of said layer elements being sufficient to reduce at least one of turbidity, adhesion, or static, and wherein said non-light-sensitive hydrophilic colloid layer and said silver halide emulsion are applied to said support at substantially the same time.

2. The process according to claim 1 wherein said substance is selected from: diethyl adipate, dibutyl adipate, di-iso-butyl adipate, di-n-hexyl adipate, di-octyl adipate, di-cyclohexyl azelate, di-2-ethylhexyl azelate, di-octyl sebacate, di-iso-octyl sebacate, dibutyl succinate, octyl stearate, dibenzylphthalate, tri-o-cresyl phosphate, diphenyl-mono-p-tert.-butyl-phenyl phosphate, monophenyl-di-o-chlorophenyl phosphate, monobutyl-di-octyl phosphate, 2,4-di-n-amyl-phenol, 2,4-di-tert.-amyl-phenol, 4-n-nonylphenol, 2-methyl-4-n-octyl phenol, N,N-diethylcaprylamide, N,N-diethylaurylamide, glycerol triallopionate, glycerol, tributyrate, glycerol monolactate diacetate, tributyl citrate, acetyltriethyl citrate, di-2-ethylhexyl adipate, dioctyl sebacate, di-iso-octyl azelate, diethylene glycol dibenzoate, dipropylene glycol dibenzoate, triethyl citrate, tri-(2-ethylhexyl) citrate, acetyl tri-n-butylcitrate, di(isodecyl)4,5-epoxytetrahydro phthalate, oligo vinyl ethyl ether, dibutyl fumarate, polyethylene oxide (polymerization grade (n)>16), glycerol tributyrate, ethylene glycol difluoro piorrate, di-(2-ethylhexyl)-isophthalate, butyl laurate, tri-(2-ethylhexyl)-phosphate, triphenyl phosphate, tri-cresyl phosphate, silicone oil, dimethyl phthalate, diethyl phthalate, dipropyl phthalate, dibutyl phthalate, di-iso-octyl phthalate, diamyl phthalate, di-n-octyl phthalate, diamyl naphthalene, tri-amyl naphthalene, monocaprin, monolaurin, monomyristin, monopalmitin, monostearin, monoolein, dicaprin, dilaurin, dimyristin, dipalmitin, distearin, diolein, 1-stearo-2-palmitin, 1-palmito-3-stearin, 1-palmito-2-stearin, triacetin, tricaprin, trilaurin, trimyristin, tripalmitin, tristearin, triolein, tripetroselin, trierucin, triricinolein, linoleodistearin, linoleodilinolenin, oleodierucin, linoleodierucin, palmitooleolinolenin, paraffin, drying oil such as linseed oil, soybean oil, perilla oil, tung oil, hempseed oil, kaya oil, walnut oil, soysauce oil, poppy seed oil, sunflower oil, catalpa oil, arrowhead oil or safflower oil; semi-drying oil such as cotton seed oil, corn oil, sesame oil, rapeseed oil, rice bran oil, lotus oil (or croton oil?), mustard oil, kafok oil or dehydrated castor oil; peanut oil, olive oil, tsubaki oil, sasanqua oil, tea seed oil, castored oil, hydrogenated castor oil, almond oil, chaulmoogra oil, or a compound represented by the following formula (I) or (II);

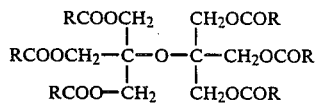

(I)

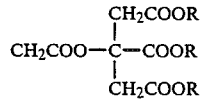

(II)

wherein R represents an alkyl group having 1 to 8 carbon atoms.

3. The process according to claim 1 wherein the average size of said oil particles is 0.01–10μ in diameter.

4. The process according to claim 3 wherein the average size of said oil particle is 0.1–10μ in diameter.

5. The process according to claim 1 wherein said substance has a melting point of not more than 50° C.

6. The process according to claim 5 wherein said substance has a boiling point not less than 180° C.

7. The process according to claim 6 wherein said substance is a compound selected from esters of glutaric acid, adipic acid, phthalic acid, sebacic acid, succinic acid, maleic acid, fumaric acid, magelaic acid, isophthalic acid, terephthalic acid and phosphoric acid, an ester of glycerin; paraffin; and fluorinated paraffin.

8. The process according to claim 7 wherein said substance is selected from tricresyl phosphate, triphenyl phosphate, dibutyl phthalate, di-n-octyl phthalate, di-2-ethylhexyl phthalate, glycerol tributyrate, glycerol tripropionate, dioctyl sebacate, paraffin, fluorinated paraffin and silicone oil.

9. The process according to claim 1 wherein the particles contain a photographic additive.

10. The process according to claim 9, wherein the photographic additive is selected from a hydrophilic additive and an oleophilic additive.

11. The process according to claim 10 wherein the photographic additive is an oleophilic additive.

12. The process according to claim 11 wherein the oleophilic additive is selected from an oil-soluble coupler, an ultraviolet absorber, a development inhibitor releasing compound, an antistain agent, a color fading inhibiting agent and an antioxidant.

13. The process according to claim 12 wherein the oleophilic additive is an ultraviolet absorber.

14. The process according to claim 13 wherein the ultraviolet absorber is selected from benzotriazoles, thiazolidones, acrylonitriles or benzophenones.

15. The process according to claim 1 wherein the thickness of the outermost layer element is 0.2–5μ.

16. The process according to claim 15 wherein said thickness is 0.5–3μ.

17. The process according to claim 1 wherein the non-light-sensitive hydrophilic colloid layer contains an organic fluorine-containing surface active agent.

18. The process according to claim 17 wherein the organic fluorine-containing surface active agent is a linear or cyclic chain compound containing at least 3 fluorine atoms and at least 3 carbon atoms.

19. The process according to claim 18 wherein the organic fluorine-containing surface active agent is selected from a cation type, nonion type or anion type.

20. The process according to claim 19 wherein the organic fluorine-containing surface active agent is an anion type.

21. The process according to claim 1 wherein said substance has a boiling point not less than 180° C.

22. The process according to claim 1 wherein the non-light-sensitive hydrophilic colloid layer contains a binder selected from gelatin, modified gelatin, casein, a hydrolysed cellulose derivative or a copolymer of vinyl compounds.

23. The process according to claim 1 wherein the non-light-sensitive hydrophilic colloid layer contains gelatin.

24. The process according to claim 1 wherein the oil particle density of the outermost layer element is not more than 0.15 cc/cc.

25. The process according to claim 1 wherein the difference in oil particle densities between the outermost layer element and the second layer element is at least 0.7 cc/cc.

26. A light-sensitive silver halide photographic material comprising a support, a silver halide emulsion layer, and a non-light-sensitive hydrophilic colloid layer consisting essentially of two layer elements, at least one of said elements containing an oil particle-forming substance, the oil particle density of the outermost layer element being not more than 0.3 cc/cc, the oil particle density of the second of said layer elements being greater than that of said outermost layer element, the difference in oil particle density between the outermost layer element and the second of said layer elements being sufficient to reduce at least one of turbidity, adhesion, of static.

27. The process according to claim 25 wherein the difference in oil particle densities between the outermost layer element and the second layer element is at least 0.7 cc/cc.

* * * * *